US007100842B2

(12) United States Patent
Meyer et al.

(10) Patent No.: US 7,100,842 B2
(45) Date of Patent: Sep. 5, 2006

(54) TWO-AXIS FULL-CIRCLE SPRINKLER

(75) Inventors: Larry P. Meyer, Walla Walla, WA (US); George Sesser, Walla Walla, WA (US); Paul D. Davisson, Walla Walla, WA (US); Frederick J. Sweet, College Place, WA (US); Craig B. Nelson, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 156 days.

(21) Appl. No.: 10/885,041

(22) Filed: Jul. 7, 2004

(65) Prior Publication Data

US 2006/0006254 A1 Jan. 12, 2006

(51) Int. Cl.
*B05B 3/02* (2006.01)

(52) U.S. Cl. ..... 239/214; 239/214.13; 239/222.11; 239/222.17; 239/222.21; 239/224; 239/244; 239/227

(58) Field of Classification Search ..... 239/214, 239/222.11, 222.17, 241, 210, 214.3, 214.21, 239/222.21, 224, 230, 233, 237, 244, 225.1
See application file for complete search history.

(56) References Cited

U.S. PATENT DOCUMENTS

| | | | | |
|---|---|---|---|---|
| 461,415 | A | 10/1891 | Bonnette | |
| 581,252 | A * | 4/1897 | Quayle | 239/279 |
| 1,821,723 | A * | 9/1931 | Perry | 239/214.25 |
| 2,493,595 | A * | 1/1950 | Rieger | 239/222.19 |
| 2,592,753 | A | 4/1952 | Sigmund | |
| 2,610,089 | A | 9/1952 | Unger | |
| 3,178,119 | A * | 4/1965 | Thorson | 239/570 |
| 3,664,585 | A * | 5/1972 | Curtis | 239/222.21 |
| 3,682,389 | A | 8/1972 | Chapin | |
| 4,073,438 | A | 2/1978 | Meyer | |
| 4,708,290 | A | 11/1987 | Osmond | |
| 4,760,958 | A | 8/1988 | Greenberg | |
| 4,796,811 | A | 1/1989 | Davisson | |
| RE33,823 | E | 2/1992 | Nelson | |
| 5,297,737 | A | 3/1994 | Davisson | |
| 5,372,307 | A | 12/1994 | Sesser | |
| 5,409,168 | A | 4/1995 | Nelson | |
| 5,415,348 | A | 5/1995 | Nelson | |
| 5,439,174 | A | 8/1995 | Sweet | |
| 5,588,595 | A | 12/1996 | Sweet | |

* cited by examiner

*Primary Examiner*—Dinh Q. Nguyen
(74) *Attorney, Agent, or Firm*—Nixon & Vanderhye, P.C.

(57) ABSTRACT

A sprinkler device comprising a sprinkler body having a longitudinal center axis, an inlet at one end and an outlet nozzle at an opposite end; and a rotor plate supported axially spaced and laterally offset from the outlet nozzle; the rotor plate mounted for orbital motion about the longitudinal axis and for rotation about a second axis offset from the longitudinal center axis, the rotor plate having grooves formed therein arranged to cause the distribution plate to rotate about the second axis when a stream emitted from the nozzle impinges on the plate, which, in turn, causes the rotor plate to orbit about the longitudinal center axis.

23 Claims, 8 Drawing Sheets

TWO-AXIS FULL-CIRCLE SPRINKLER

TECHNICAL FIELD

This invention relates generally to sprinklers and, more particularly, to a two-axis, full-circle sprinkler which may incorporate one or a pair of viscous brake devices to slow the rotational speed of certain sprinkler components including the water distribution or rotor plate.

BACKGROUND OF THE INVENTION

It is well known in the field of irrigation generally and rotating sprinklers particularly for a sprinkler device to emit a non-rotating stream from a fixed nozzle onto a rotating plate with substantially radial grooves that nevertheless establish a moment arm, causing the plate (often referred to as a "rotor plate") to rotate about the nozzle axis. The plate grooves also reorient the stream from vertical to substantially horizontal, distributing the water in a circular pattern. The grooves of the rotor plate may be configured to produce different wetting patterns, depending on specific site applications. In some cases, the rotation of the rotor plate is slowed by a viscous brake or "motor" in order to maximize the throw radius of the stream. In others, the rotor may be of the free-spinning type. Examples of such sprinkler constructions may be found in commonly owned U.S. Pat. Nos. Re. 33,823; 4,796,811; 5,297,737; 5,372,307; 5,439,174; and 5,588,595.

It is nevertheless desirable to improve the performance characteristics of such sprinkler devices, and to build in greater flexibility with respect to producing desirable distribution curves in a simpler more cost effective manner.

BRIEF DESCRIPTION OF THE INVENTION

In accordance with the present invention, a two-axis, full-circle sprinkler is provided in which the rotor plate orbits about a first axis and, at the same time, rotates about a second axis parallel to, or at an angle to, the first axis. In the disclosed embodiments, the first axis is the longitudinal center axis of the sprinkler and sprinkler nozzle.

In one embodiment, the rotor plate is supported eccentrically downstream of the nozzle on a link arm which is itself rotatable about the longitudinal axis of the sprinkler.

In another embodiment, the rotor plate is supported eccentrically on a spinner which is, in turn, mounted concentrically on the sprinkler nozzle.

In still another embodiment, the rotor plate is supported eccentrically downstream of the nozzle on a rotor rotatably mounted within the sprinkler body. The nozzle itself is also supported on the rotor, lying on the longitudinal axis of the sprinkler body.

In still another embodiment, the rotor plate is supported for rotation about an axis parallel to the nozzle axis on a gear train cage, the latter utilized to slow the rotation of the rotor plate.

It is also a feature of the invention that a viscous retarder may be incorporated into the rotor plate to slow the rotation of the plate about the second axis. In addition, the orbiting motion of the rotor plate about the first axis may be slowed by incorporation of a second viscous retarder in the sprinkler body. Alternatively, one or the other of the retarders may be omitted. Thus, various embodiments of free-spinning and/or braked components may be employed to achieve the desired sprinkling pattern. Moreover, the viscous type retarder may be replaced in some instances by other braking devices, such as a gear reduction drive or mechanical friction device if desired.

Other features include:

1. the sprinkler can achieve three hundred sixty degree (360°) coverage;
2. the rotor plate can be grooved to provide multiple stream trajectories and diffusion patterns;
3. no pressurized seals are needed;
4. multiple flow rates and pressures can be used with a single device;
5. flexibility of pattern choices is facilitated by modular construction of various sprinkler components;
6. the sprinkler is operable in different orientations; and
7. manufacturing procedures to achieve wide degree of flexibility are simplified.

Accordingly, in one aspect, the invention provides a sprinkler comprising a sprinkler body having a longitudinal center axis, an inlet at one end and an outlet nozzle at an opposite end; and a rotor plate supported in axially spaced and laterally offset relation to the outlet nozzle; the rotor plate mounted for orbital motion about the longitudinal axis and for rotation about a second axis offset from the longitudinal center axis, the rotor plate having grooves formed therein arranged to cause the rotor plate to rotate about the second axis when a stream emitted from the nozzle impinges on the plate.

In another aspect, the present invention provides a sprinkler device comprising a sprinkler body having a longitudinal center axis, an inlet at one end and an outlet nozzle at an opposite end; and a rotor plate supported in axially spaced and laterally offset relation to the outlet nozzle; the rotor plate mounted for orbital motion about the longitudinal axis and for rotation about a second axis offset from the longitudinal center axis, the rotor plate having grooves formed therein arranged to cause the distribution plate to rotate about the second axis when a stream emitted from the nozzle impinges on the plate.

The invention will now be described in detail in connection with the drawings identified below.

DETAILED DESCRIPTION OF THE INVENTION

Figure 1:
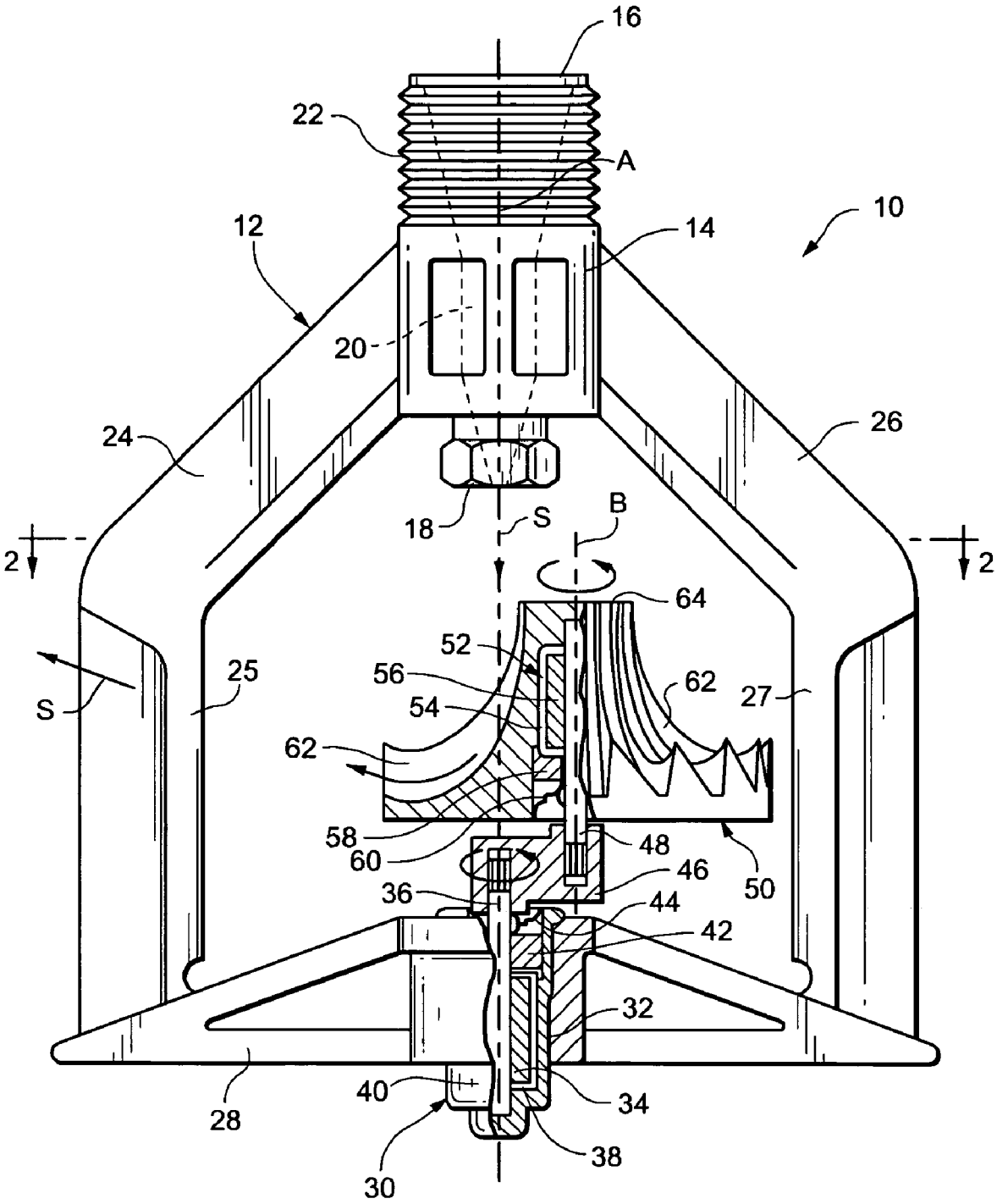
FIG. 1 is a front elevation, partly in section, of a two-axis, full-circle sprinkler in accordance with a first exemplary embodiment of the invention.

With reference to FIG. 1, a sprinkler 10 in accordance with a first exemplary embodiment of the invention includes a strut-type sprinkler body 12 including a tubular portion 14 having an inlet 16 and an axially aligned outlet 18 which may be in the form of an interchangeable, threaded nozzle. An internal bore 20 connects the inlet 16 with the nozzle 18, defining an axial flow path for the water supplied to the sprinkler. The exterior of the inlet end of portion 14 may be threaded as shown at 22 to facilitate connection to the water supply hose or other hardware, e.g., a pressure regulator.

The body 12 also includes a pair of struts 24, 26 extending downwardly away from the tubular portion 14, remote ends of the struts 24, 26 connected by a crossbeam 28. Struts 24, 26 may have a blade shape at 25 and 27 to minimize any obstruction of the stream as it passes across the struts 24, 26. The crossbeam 28 supports a first speed retarder device which is shown as a viscous brake 30 which may be press-fit, snap-fit or otherwise suitably secured within a through bore 32 centrally located in the crossbeam 28 between the struts 24, 26. The viscous brake 30 is of known construction, and is found on various sprinkler heads commercially available from the assignee. Reference is also made to the commonly owned patents identified hereinabove. Briefly, the viscous brake 30 includes a rotor 34 fixed to a rotatable shaft 36 supported within a chamber 38 in the brake housing 40 via bearing 42. The chamber 38 contains a viscous fluid (preferably but not necessarily a silicone fluid) which otherwise slows the rotation of the shaft 36 by way of viscous "shearing" of the fluid in the chamber 38. An annular seal 44 (held in place by a cap or retainer not shown) prevents escape of fluid from the housing end where the shaft 36 exits the latter. The shaft 36 rotates about a longitudinal axis A of the tubular portion 14 extending through the orifice of nozzle 18.

The end of the shaft 36 exterior of the housing supports a horizontal crank arm, or eccentric coupler 46 that is fixed to the shaft so that the shaft and link arm rotate together. The other end of the crank arm 46 receives one end of a second shaft 48 which is parallel to but offset from the first shaft 36. The second shaft 48 supports a water distributor (or rotor) plate 50 for rotation relative to the shaft 48 about a second axis B extending parallel to but offset from axis A. The rotor plate 50 includes a second viscous brake device 52. More specifically, the rotor plate is formed with an interior chamber 54 through which the shaft 48 passes. The shaft 48 has a stator 56 secured thereto, in close proximity to the chamber wall. Here again, the chamber is filled or partially filled with a viscous fluid to retard rotation of the plate about the shaft 48. A bearing 58 supports the shaft, and an adjacent seal 60 prevents escape of fluid from the chamber 54.

Figure 2:
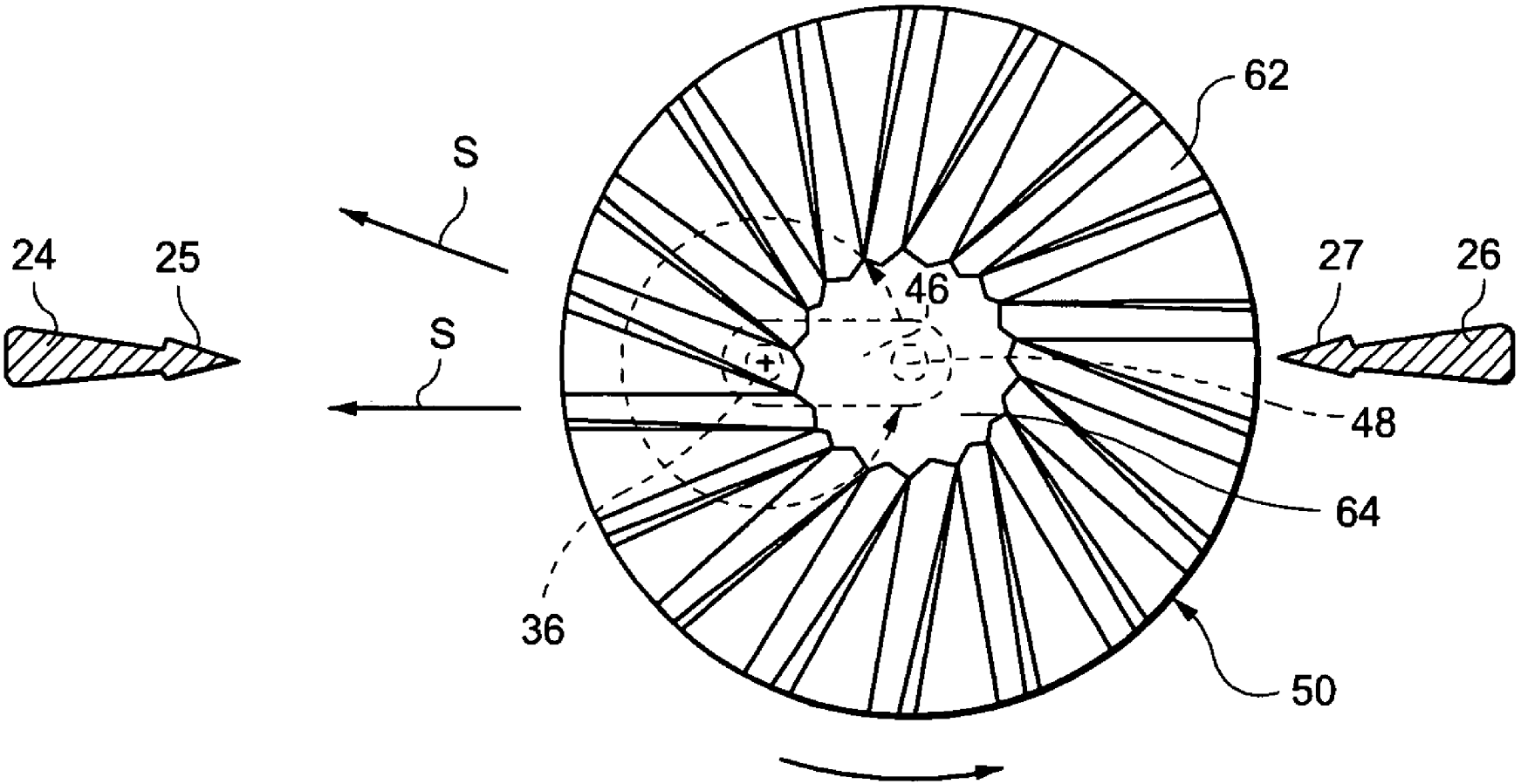
FIG. 2 is a partial plan view, also partly in section, of the rotor plate utilized in the sprinkler shown in FIG. 1.

The exterior of the rotor plate is formed with a plurality of grooves 62 on the side of the plate facing the nozzle 18. The grooves have radially inner substantially vertical surfaces adjacent the nozzle that transition to generally horizontal surfaces at radially outer positions where the stream or streams exit the plate. The grooves 62 are also asymmetrically arranged relative to the axis B as best seen in FIG. 2 so that a moment arm is established for each groove which causes the plate to rotate about the shaft 48 (and axis B) when a stream issues from the nozzle 18 and impinges on the grooves. Further in this regard, the grooves lie about the periphery of a circle at the end of the plate closest to the nozzle (defined by flat surface 64), and the plate is located (by the length of the link arm 46) so that the stream S is substantially aligned vertically with the grooves. In other words, the stream first impinges on the vertical components of the grooves 62 without also impinging on the flat surface 64 of the plate. Various groove configurations are possible, depending on the desired sprinkling pattern.

The operation of the sprinkler is as follows: As the stream exits the nozzle 18 along longitudinal axis A, it impinges on grooves 62 in the rotor plate 50 and redirects the stream outwardly and nearly perpendicularly to the axis A. The arrangement of the grooves in the rotor plate 50 cause the plate to rotate about axis B as mentioned above. The moment arm of the exiting stream relative to the shaft 48 (which is coincident with axis B) also causes the link arm 46 and shaft 36 to rotate in a direction opposite the rotation of the plate 50 about shaft 48. Thus, as the plate 50 rotates-about the shaft 48 (and axis B) in one direction, both the plate 50 and shaft 48 orbit about the shaft 36 (and longitudinal axis A) in the same or opposite direction, depending on the arrangement of grooves 62 in the plate 50. The use of brakes 30 and 52 significantly slows the rotation of both shafts 36 and 48 (and hence, rotor plate 50).

It should be pointed out here, however, that it is not necessary to dampen or retard the rotation of the shaft 48, nor is it necessary to dampen the rotation of the link arm 46 and shaft 36. One or the other or both may be freely spinnable about their respective axes. Moreover, if a retarder is to be used, it may be a viscous fluid dampening device as illustrated, or other means such as, for example, a gear train, flywheel, or other mechanical friction arrangement. In still another variation, two viscous brake mechanisms may be employed with different levels of retardation, by simply changing the viscosity of the fluid in one or the other of the brake chambers. In other words, the above-described rotator/spinner construction is designed for flexibility in that a multitude of combinations can be employed to fulfill a variety of water application needs consistent with the desire to provide an effective water distribution curve with minimal time devoted to rotor plate groove design. For example, the above-described embodiment tends to be less sensitive to water pressure and flow rate variations than other designs, thereby minimizing change out of rotor plates. In this regard, the action of the various grooves 62 in the rotor plate 50, rotating in and out of the water stream, tends to fill in the water distribution curve (the amount of water v. distance from sprinkler) in a desirable fashion. The action delivers a uniform level of both long distance (wind fighting) and in-close coherent water streams.

It should also be noted that while the sprinkler 10 in FIG. 1 is shown in a particular orientation where the plate 50 is located vertically below the nozzle 18, it will be understood by those skilled in the art that the sprinkler 10 may be inverted for different applications so that the stream emitted from the nozzle 18 travels upwardly into engagement with the rotor plate 50. Thus, references to terms such as "above", "below", "upward", "downward", and the like are utilized for reference purposes only, it being understood that the sprinkler itself can be utilized in other orientations.

Figure 3:
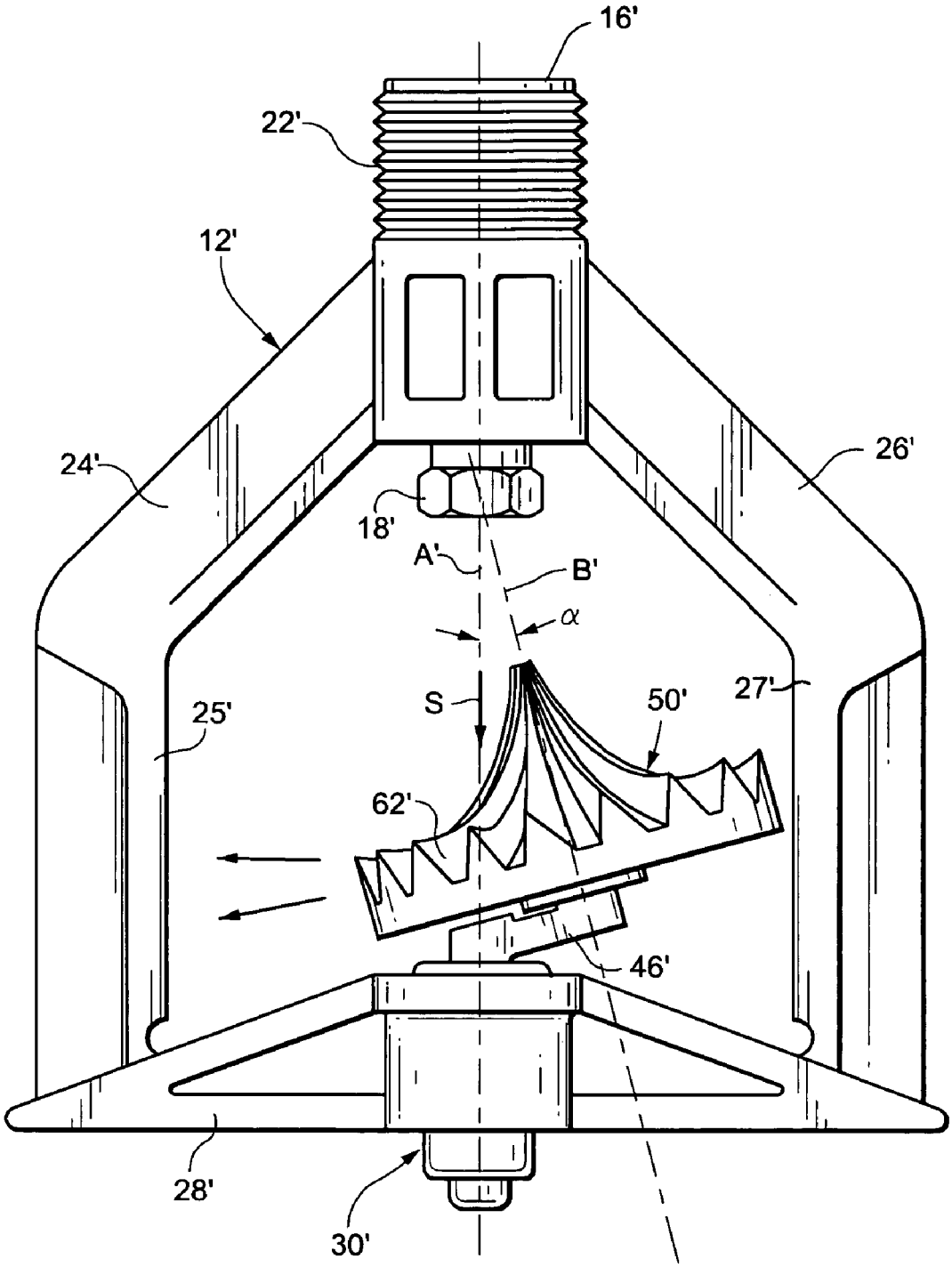
FIG. 3 is a front elevation of a two-axis, full-circle sprinkler in accordance with a second exemplary embodiment of the invention.

Turning now to FIG. 3, a second exemplary embodiment of the invention is disclosed which varies in certain respects from the sprinkler illustrated in FIGS. 1 and 2. For convenience, similar reference numerals are utilized to designate corresponding components, but with the prime designation (') added. Moreover, since the similarities in the embodiments are readily apparent, only the differences will be described in detail. The rotor plate 50' in this second exemplary embodiment is shown as a free-spinning plate without an internal viscous braking device of the type illustrated in FIG. 1. It will be understood, however, that the rotor plate may also be substantially identical to that illustrated in FIG. 1. Another difference in this second exemplary embodiment relates to the configuration of the link arm 46. Here, the link arm or eccentric coupler 46' is formed so as to tilt the rotor plate 50' relative to the longitudinal axis A', so that the axis B' of the plate extends at an acute angle a relative to the axis A'. Tipping the axis of the rotor plate 50' provides a nutating type of action with damping of the rotation of the link arm 46' by viscous brake 30'. This creates a "washing" type of water pattern where the stream trajectory is constantly changing due to the rotation of the plate 50' on the tipped axis B'. Here again, the viscous brake 30' which retards rotation of the link arm 46' may be eliminated so that both shafts (not clearly shown, but corresponding to shafts 36 and 48) spin freely. Alternatively, plate 50' may be braked and link arm 46' may be freely spinnable.

Figure 4:
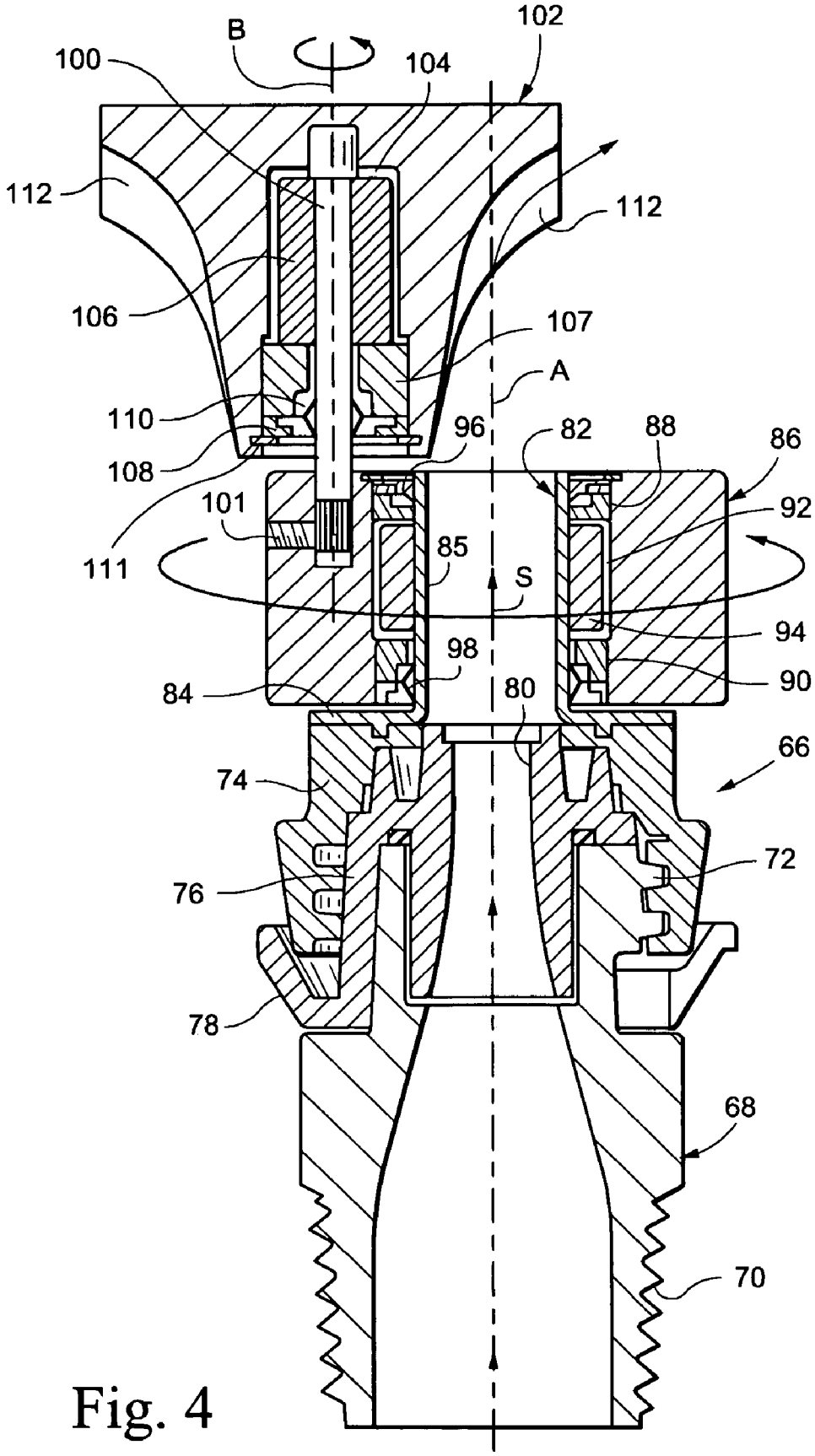
FIG. 4 is a front section of a two-axis, full-circle sprinkler in accordance with a third exemplary embodiment of the invention.

Turning now to FIG. 4, a third exemplary embodiment of the invention is illustrated. In this embodiment, a strutless sprinkler construction is employed. The sprinkler body 66 includes an inlet connector 68 by which the sprinkler may be connected to a supply hose or other supply hardware. To this end, the lower end of the connector is externally threaded at 70. The upper end of the connector is also exteriorly threaded, as indicated at 72. An external sleeve 74 is adapted to be threadably secured to the upper end of the connector, sandwiching a nozzle component 76 therebetween. This nozzle construction is of the type generally shown and described in commonly owned U.S. Pat. No. 5,415,348, and incorporates an externally visible identification band 78 by which the user can identify variously sized, interchangeable nozzles available from the assignee.

Fixed to the upper or outlet end of the sleeve 74, and adjacent the nozzle orifice 80, there is fixed a flanged tubular member 82, with the axis of the tubular member coincident with the longitudinal axis A of the sprinkler body and nozzle. The flanged tubular member 82 includes a radially outwardly extending horizontal flange 84 which is mounted on the upper face of the sleeve 74 while the tubular portion 85 extends upwardly away from the nozzle component 76. A spinner 86 is mounted on the tubular portion 85 for rotation about the longitudinal axis A. Upper and lower bearings 88 and 90, in combination with the rotator or spinner interior wall, define an internal chamber 92 filled or partially filled with a viscous fluid. At the same time, an annular stator member 94 is secured to the tubular portion 85 of member 82 at a location such that the stator member 94 is received centrally within the chamber 92. Annular seals 96 and 98, held in place by conventional retainers, serve to prevent escape of viscous fluid from the chamber 92.

A shaft 100 is fixed within the spinner 86 at one side thereof (fixed by a set screw 101) and extends upwardly so as to support a rotor plate 102 for rotation relative to the shaft 100. This rotor plate 102 is generally similar to the rotor plate 50 previously described, although the orientation is reversed. The plate 102 is provided with an interior chamber 104 through which the shaft 100 passes. The shaft 100 has a stator member 106 fixedly secured thereto in close proximity to the chamber wall. This chamber is also filled or partially filled with a viscous fluid to retard rotation of the plate 102 about the shaft 100. The lower end of the chamber is closed by a shaft bearing 107 along with a cap 108 and a seal 110 held in place by a retainer 111 to prevent escape of fluid from the chamber 104. The shaft 100 defines a second longitudinal axis B which extends parallel to but which is offset from, the first longitudinal axis A of the sprinkler body. It should be appreciated that the rotor plate could also be supported for free rotation and, in such case, the viscous fluid would be eliminated in favor of a lubricating grease or oil.

The plate 102, like the plate 50, is provided with a plurality of grooves 112 which may have a configuration generally similar to those of the plate 50, so that the stream from the nozzle orifice 80, after passing through the tubular portion 85, impinges the grooves 112 of the plate 102 in the same manner as the plate 50, causing the plate 102 to rotate about the fixed shaft 100. This spinning action of the plate 102 about the shaft 100, i.e., about axis B, also causes the rotator or spinner 86 to rotate about the tubular member 82, i.e., about axis A in a direction opposite the rotation of the plate 102 (similar to the embodiment illustrated in FIG. 1).

Figure 5:
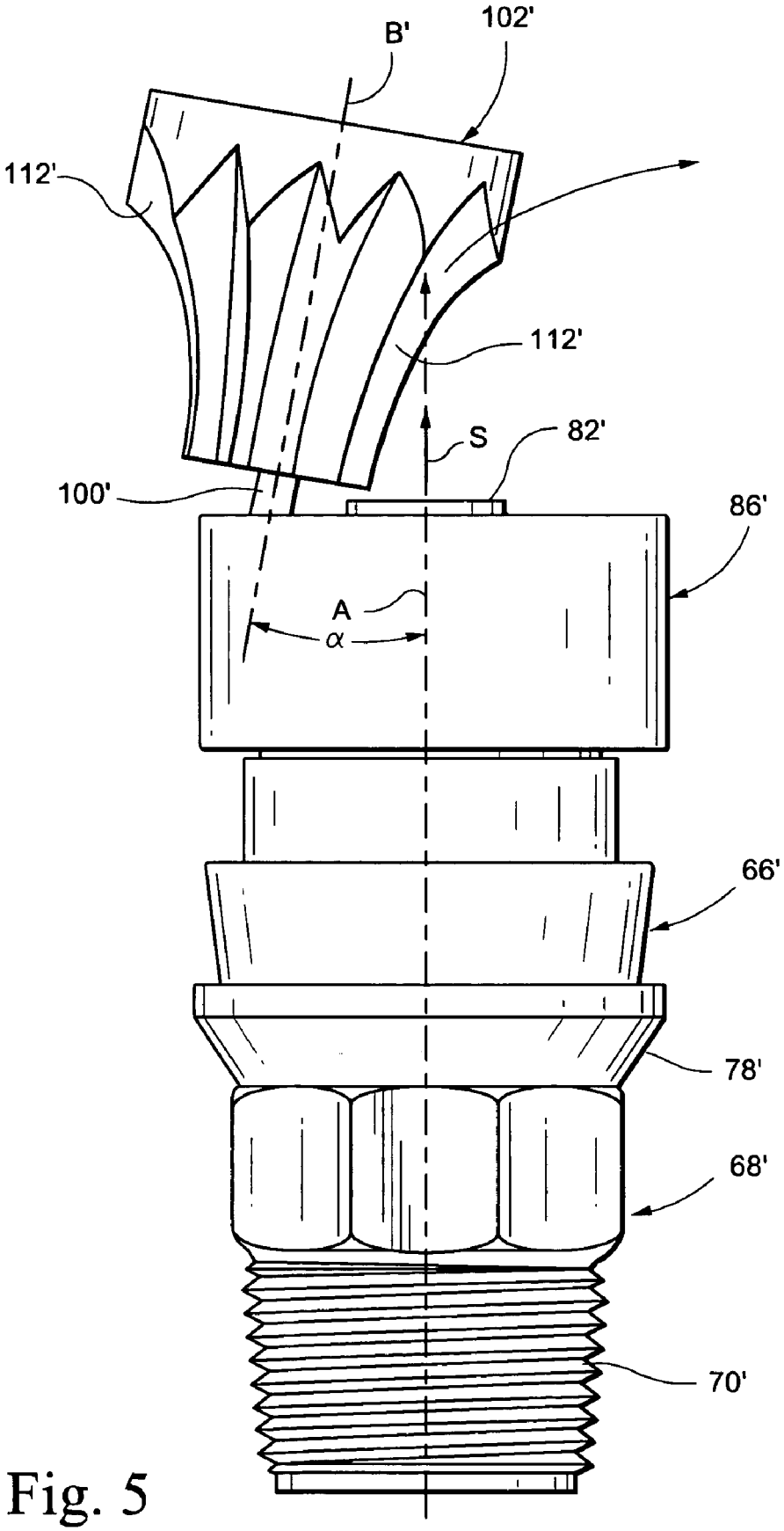
FIG. 5 is a front elevation of a two-axis, full-circle sprinkler in accordance with a fourth exemplary embodiment of the invention.

In FIG. 5, a variation of the embodiment in FIG. 4 is shown. For convenience, similar reference numerals are utilized but with the prime designation (') added. In this variation, the plate 102' is mounted for rotation on and relative to a shaft 100' defining an axis B' which extends upwardly from the spinner 86' at an acute angle relative to the longitudinal axis B'. Because the plate 102' is "tipped", the trajectory of the stream S as it leaves the plate 102' constantly changes due to the action of the grooved rotor plate 102' rotating about a tilted axis.

Figure 6:
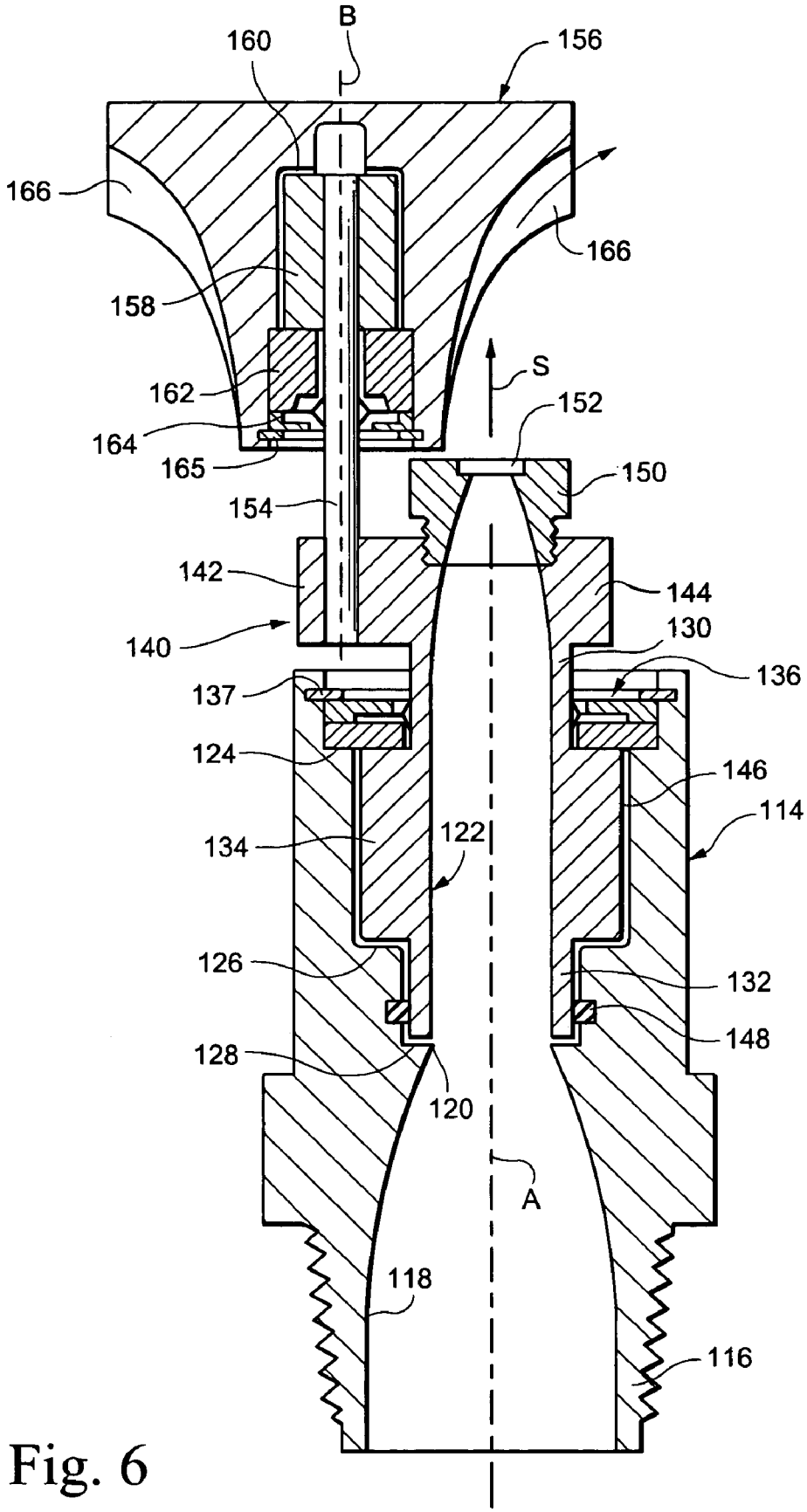
FIG. 6 is a front section of a two-axis, full-circle sprinkler in accordance with a fifth exemplary embodiment of the invention.

FIG. 6 illustrates yet another embodiment of the invention which also utilizes a double viscous brake and double offset axes configuration. Specifically, the sprinkler body 114 has an exteriorly threaded integral inlet end 116, an inlet passage 118 decreasing in diameter to a location 120 where the passage 118 is continued through a rotor member 122 seated within the body 114. The sprinkler body 114 is formed in an upper portion thereof with annular internal flanges or shoulders 124, 126 and 128, with the latter adjacent the narrowed diameter location at 120.

The rotor 122 is formed with relatively small diameter stems 130, 132 on opposite sides of an enlarged rotor portion 134. The lower stem 132 is located closely adjacent the shoulder 128, while the underside of the enlarged rotor portion 134 is closely adjacent the shoulder 126. A cap and seal assembly 136 is seated on the shoulder 124, and the upper stem 130 extends upwardly through the seal assembly 136. An eccentric coupler or crank arm is formed at the top of the upper stem 130, extending radially on one side 142 a substantially greater distance than on the other side 144.

The above-described arrangement establishes a viscous liquid chamber 146 extending from an O-ring 148 on the lower stem to the cap and seal assembly 136 at the upper stem. A retainer 137 holds the assembly in place. As in the previous embodiments, the chamber 146 is filled or partially filled with a viscous fluid.

The crank arm 140 supports a nozzle 150 with a nozzle orifice 152 aligned axially with the longitudinal axis A of the sprinkler body 114. A shaft 154 defining a parallel axis B is mounted in the longer, asymmetric side of the crank 140 and extends vertically upwardly, supporting a rotor plate 156 for rotation relative to the shaft. In this regard, the shaft 154 mounts a stator member 158 within a chamber 160 formed interiorly of the plate 156. The opening in the plate 156 is closed by a bearing 162 and seal and cap assembly 164, and held in place by a retainer 165. The arrangement here is similar to that described in connection with the FIG. 4 embodiment.

With a vertical stream S issuing from orifice 152 and impinging on grooves 166 in the plate, the latter is caused to rotate about the shaft 154, i.e., axis B, but is slowed by the viscous shearing action between the stator member 158 and the peripheral wall of the rotating chamber 160. At the same time, the rotation of plate 156 causes the crank arm 140 and rotor 122 to rotate in the opposite direction about the axis A, slowed by the viscous shearing action between the rotor portion 134 and the peripheral wall of the chamber 146. As in the previously described embodiments, one or the other or both of the retarders may be removed in favor of freely spinnable components, and if desired, the shaft 154 may be tipped as shown in the FIG. 5 embodiment.

Figure 7:
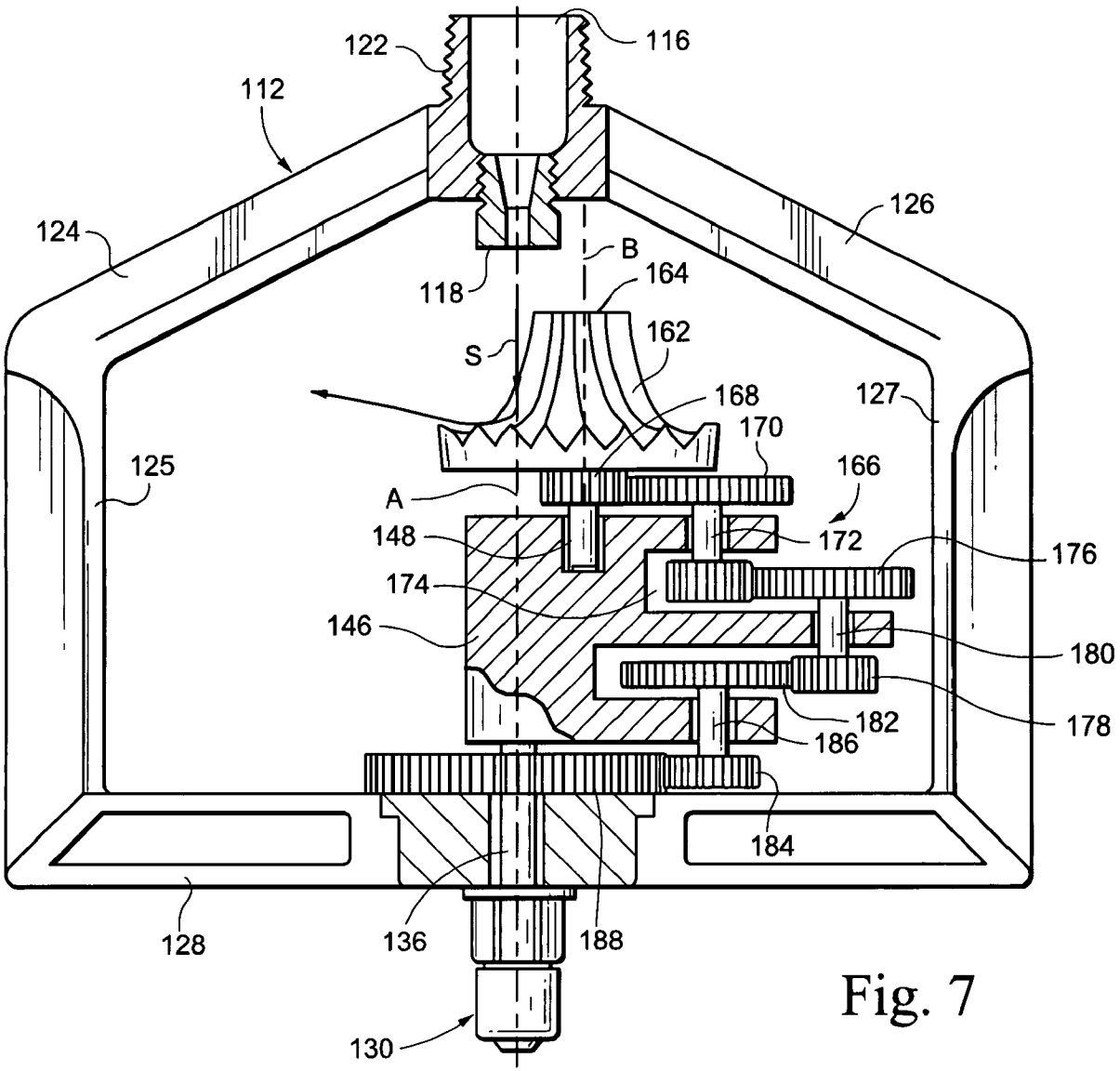
FIG. 7 is a front elevation, partly in section, of a two-axis, full-circle sprinkler in accordance with a sixth exemplary embodiment of the invention.

Turning now to FIG. 7, an alternative to the embodiment in FIG. 1 is illustrated wherein the viscous retarder for the rotor plate in FIG. 1 has been omitted in favor of a gear reduction drive. In FIG. 7, because of the overall similarity between the sprinkler construction in that figure and in FIG. 1, similar reference numerals are used to designate corresponding components, but with the prefix "1" added. For the sake of brevity, no detailed description of the similar corresponding components is necessary. Thus, in FIG. 7, the eccentric link or arm 146 is provided in the form of a gear cage. The cage or holder 146 supports the rotor plate 162 and its shaft 148 for rotation about the axis B. It will be understood that as the gear holder 146 rotates about axis A, the rotor plate 162 will orbit about axis A while also rotating in an opposite direction about its own axis B. The rotation of the gear holder 146 about axis A is slowed by a viscous retarder 130, while the rotation of the rotor plate 162 about axis B is slowed by a gear reduction assembly 166. More specifically, sprocket 168 fixed to the shaft 148 meshes with a gear 170 connected via shaft 172 to a smaller gear 174. The latter meshes with a larger gear 176 which, in turn, is connected to a smaller gear 178 by means of a shaft 180. The gear 178 meshes with the gear 182 which is connected to a smaller gear 184 via shaft 186. The gear 184 meshes with a larger gear 188 which is fixed to the sprinkler body, i.e., gear 188 is stationary and the gear 184 orbits about the stationary gear 188 as the cage 146 rotates about axis A. Note that shaft 136 extending from the viscous motor 130 passes through the fixed gear 188 and is secured to the gear carrier or cage 146 for rotation therewith. The reduction gear train as described effectively slows the rotation of the rotor plate 162 about axis B. It will be appreciated that other gear reduction arrangements may be employed to effect the same result.

Figure 8:
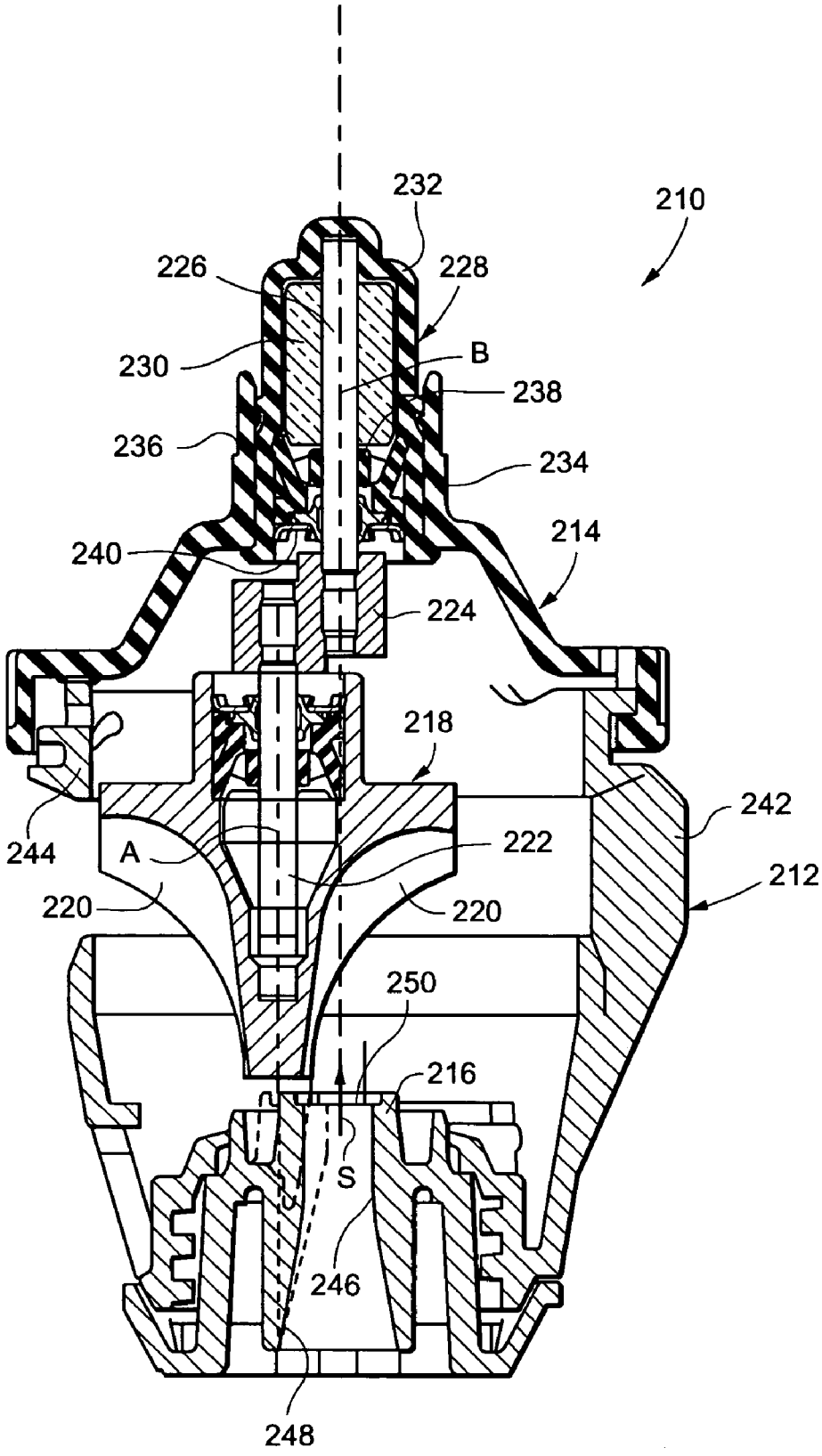
FIG. 8 is a front elevation of a two-axis, full-circle sprinkler in accordance with a seventh embodiment of the invention.

With reference now to FIG. 8, a presently preferred embodiment of the invention is illustrated wherein the two-axis rotor plate and nozzle assemblies are incorporated within a sprinkler body of the type disclosed in commonly owned U.S. Pat. No. 5,415,348. More specifically, the modular sprinkler 210 includes generally, a body 212, a removable cap assembly 214 and a nozzle 216. The sprinkler would typically have an adapter upstream of the nozzle 216 by which the sprinkler can be attached to, for example, a pressure regulator or water supply tube or hose. The cap assembly 214 supports a water distributor or rotor plate 218 which redirects in a substantially radial direction a stream issuing from an interchangeable nozzle 216 by reason of grooves 220 formed in the plate (which may be similar to the plates illustrated in the previously described embodiments). Plate 218 is mounted on a first shaft 222 that extends into an eccentric coupler 224. A second shaft 226 extends from the coupler 224 into a viscous brake or rotor motor 228 as previously described. In this regard, a rotor 230 is fixed to the shaft for rotation therewith in the brake housing 232. Rotation of the plate 218 is controlled by a viscous fluid in the housing 232 which is secured (by, for example, a snap-fit arrangement) within a centrally oriented hub portion 234 of the cap assembly 214. The viscous brake is similar to the earlier-described brakes and need not be further described. An annular seal 236 prevents fluid from escaping from the brake housing 232 and includes an integral shaft bearing 238. The seal 236 is held in place by a retainer 240.

The cap assembly 214 may be secured to an upper end of the sprinkler body 212 as described in commonly owned U.S. Pat. No. 5,409,168. The sprinkler body 212 includes three equally circumferentially spaced struts 242 (one shown) connected at their upper end by a mounting ring 244 on which the cap assembly is removably secured. The lower end of the sprinkler body 212 supports the interchangeable nozzle 216 in the manner described in commonly owned U.S. Pat. No. 5,415,348. Nozzle 216 includes a central tubular portion 246 defining a flow passage having an inlet 248 at one end and a discharge orifice 250 at an opposite outlet end. As best seen in FIG. 8, a nozzle stream S issuing from the nozzle will impinge on the grooves 220 of the rotor plate 218, causing the latter to rotate in one direction about an axis A of the shaft 222 while the rotor plate 218 and shaft 222 orbit about a second axis B of shaft 226 extending into the rotor motor 228. The operation of the sprinkler illustrated in FIG. 8 is similar to the earlier-described embodiments, for example, the embodiment illustrated in FIG. 1.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler device comprising a sprinkler body having a longitudinal center axis, an inlet at one end and an outlet nozzle at an opposite end; and a rotor plate supported axially spaced and laterally offset from said outlet nozzle; said rotor plate mounted for orbital motion about said longitudinal center axis and for rotation about a second axis offset from said longitudinal center axis, said rotor plate having grooves formed therein arranged to cause said distribution plate to rotate about said second axis when a stream emitted from said nozzle impinges on said plate, which, in turn, causes said rotor plate to orbit about said longitudinal center axis, wherein said second axis is substantially parallel to said longitudinal center axis.

2. The device of claim 1 and including a retarding device for slowing the rotation of said rotor plate about said second axis.

3. The device of claim 2 and including a second retarding device for slowing the orbital motion of the rotor plate about said longitudinal center axis.

4. The device of claim 1 and including a retarding device for slowing the orbital motion of the rotor plate about said longitudinal center axis.

5. The device of claim 1 wherein said outlet nozzle is stationary.

6. The device of claim 1 including a crank arm mounted on a first shaft lying on said longitudinal center axis, said rotor plate mounted on one end of a second shaft, the other end of said second shaft mounted in one end of said crank arm.

7. The device of claim 6 wherein said rotor plate is rotatable relative to said second shaft and said crank arm is rotatable with said first shaft.

8. The device of claim 7 wherein said rotor plate is provided with an internal chamber having a quantity of viscous fluid therein, and wherein said second shaft passes through said chamber and supports a fixed stator element within said chamber.

9. The device of claim 8 wherein said crank arm is mounted on said first shaft for substantially free rotation about said longitudinal center axis.

10. The device of claim 7 wherein said rotor plate is mounted on said second shaft for substantially free rotation relative thereto.

11. The device of claim 10 wherein said rotor plate is mounted on said second shaft for substantially free rotation relative thereto.

12. The device of claim 7 wherein one end of said first shaft supports said crank arm, and an opposite end of said first shaft is mounted for rotation within a housing, said housing having an internal chamber having a quantity of viscous fluid therein, said first shaft extending through said chamber and supporting a rotor element within said chamber.

13. The device of claim 7 wherein said crank arm is mounted on said first shaft for substantially free rotation about said longitudinal center axis.

14. The device of claim 1 wherein a pair of struts extend away from said sprinkler body, said struts connected at remote ends by a crossbeam, and wherein said rotor plate is mounted to said crossbeam.

15. The device of claim 1 wherein a spinner component is supported in said sprinkler body between said outlet nozzle and said rotor plate, and further wherein said rotor plate is mounted on said spinner component.

16. The device of claim 15 wherein said spinner component is rotatable about said longitudinal center axis, and wherein means are provided for braking the rotation of said spinner component.

17. The device of claim 16 wherein said rotor plate is mounted on a shaft extending from said spinner component for rotation about said second axis.

18. The device of claim 17 wherein means are provided for braking the rotation of said rotor plate.

19. The device of claim 15 wherein said second axis is substantially parallel to said longitudinal center axis.

20. The device of claim 1 wherein said nozzle is stationary.

21. The device of claim 1 wherein said nozzle rotates about said longitudinal center axis and said rotor plate is mounted on a carrier supporting said nozzle, said carrier rotatable about said longitudinal center axis.

22. A sprinkler device comprising a sprinkler body having a longitudinal center axis, an inlet at one end and an outlet nozzle at an opposite end; and a rotor plate supported in axially spaced and laterally offset relation to said outlet nozzle; said rotor plate mounted for orbital motion about said longitudinal axis and for rotation about a second axis offset from said longitudinal center axis, said rotor plate having grooves formed therein arranged to cause said distribution plate to rotate about said second axis when a stream emitted from said nozzle impinges on said plate, wherein said second axis is substantially parallel to said longitudinal center axis.

23. The sprinkler device of claim 22 wherein said rotor plate is mounted in an eccentric gear carrier for rotation about second axis; said gear carrier mounted for rotation about said longitudinal center axis; and wherein a gear reduction train is supported within said gear carrier for slowing the rotation of said rotor plate about said second axis.

* * * * *